US006146772A

United States Patent [19]

Terziani

[11] Patent Number: 6,146,772

[45] Date of Patent: Nov. 14, 2000

[54] COMPOSITE WIRE FOR THE MANUFACTURE OF JEWELRY ARTICLES

[75] Inventor: Urbano Terziani, Arezzo, Italy

[73] Assignee: Cento Group S.p.A., Arezzo, Italy

[21] Appl. No.: 09/084,934

[22] Filed: May 28, 1998

[30] Foreign Application Priority Data

Jul. 4, 1997 [IT] Italy ..... FI97A0157

[51] Int. Cl.[7] ..... H01F 1/16; B32B 15/01

[52] U.S. Cl. ..... 428/544; 428/577; 428/582; 428/670

[58] Field of Search ..... 428/544, 577, 428/582, 670, 672, 673; 63/4, 15, 15.7; 29/896.4, 896.43; D11/13

[56] References Cited

U.S. PATENT DOCUMENTS 4,716,750 1/1988 Tizzi ..... 72/52

FOREIGN PATENT DOCUMENTS 0638256 2/1995 European Pat. Off. .
832734 2/1952 Germany .
1154682 1/1987 Italy .
604599 9/1978 Switzerland .

*Primary Examiner*—D. S. Nakarani
*Assistant Examiner*—H. Rickman
*Attorney, Agent, or Firm*—Browdy and Neimark

[57] ABSTRACT

A composite wire for the manufacture of semifinished products to be subjected to an emptying process in the field of goldsmithery. The wire comprises a support core developing essentially along one of its longitudinal axes in a nonprecious metal that is removable by chemical or electrochemical means as well as a plurality of sections in precious metal having an essentially longitudinal development of which at least a portion of each one is radially engaged in the core.

9 Claims, 3 Drawing Sheets

COMPOSITE WIRE FOR THE MANUFACTURE OF JEWELRY ARTICLES

DESCRIPTION

1. Field of the Invention

The present invention relates to a composite wire for the manufacture of jewelry articles and more particularly for producing semifinished products, from which said jewelry articles are obtained, by subjecting them to a emptying process.

The invention also relates to a process for the production of said composite wire as well as ornamental articles, in particular of an annular form, or the chains made with said articles which can be manufactured from said composite wire by means of mechanical processing and an emptying process.

2. Description of the Prior Art

The techniques for the production of "hollow" articles or, in other words, articles composed of tubular elements conformed in various ways to form chain links, earrings, charms and the like in precious metals are well known in the field of goldsmithery.

The most widely used technique in the manufacturing of ornamental articles made of hollow wire, mainly for ornamental chains, is the one in which there is used a composite wire formed from a support core in a nonprecious metal (iron, copper or special alloys, such as tombak), on which a lamina of precious metal is folded. The lamina is firmly secured to the support core by engaging the longitudinal edges of the lamina in respective axial grooves formed on the surface of the support core and subjecting this intermediate semifinished product to the mechanical process of drawing in order to obtain the desired diameter. The composite wire obtained with this technique can be used in manual or mechanical processing just as a common solid wire is used, for example, to produce ornamental chains. The internal support core is subsequently removed (emptying process) by means of chemical or electrochemical treatment to which the products are subjected. This technique is described in Italian patent no. 1154682.

With the process described above, it is possible to obtain wire material of a conventional form allowing only for the possibility of changing the cross section. Furthermore, with said technique, it is not possible to create a wire comprising more than one type of precious metal. Finally, the possibility of being able to propose new ornamental shapes and new techniques for producing such shapes, having a high level of flexibility of application and offering opportunities for creative activity on the part of the designer is in high demand in the field of gold craftsmanship.

SUMMARY OF THE INVENTION

The object of the present invention is, therefore, to provide a composite wire of a novel structure that can be used in the field of gold craftsmanship for the manufacturing of semifinished products to be subjected to a process of emptying which would, after said treatment, give rise to articles of jewelry having an original configuration.

A further object of the present invention is to provide a composite wire of the above-mentioned type as well as a method to produce such wire which provides the designer with a vast range of possibilities to create articles of jewelry having an original configuration.

These and other objectives, which will become apparent in the description which follows, are accomplished with the composite wire according to the present invention whose novel feature consists in the fact that it comprises an elongate support core in a nonprecious metal that can be removed by chemical or electrochemical means as well as a plurality of elongate sections in precious metal of which at least a portion of each is radially engaged in said core.

In one currently preferred embodiment of the invention, said sections engage in grooves having a depth equal to the width of the sections or are incorporated in said core inside grooves which have a depth greater than their width and close over them.

Said sections can have a substantially flat, curvilinear or C-shaped laminar form.

BRIEF DESCRIPTION OF THE DRAWINGS

Further characteristics and/or advantages of the composite wire according to the invention will become apparent in the description which follows of some embodiments thereof, given as examples but not limitative, with reference to the attached drawings in which.

DESCRIPTION OF A PREFERRED EMBODIMENT

Figure 1:
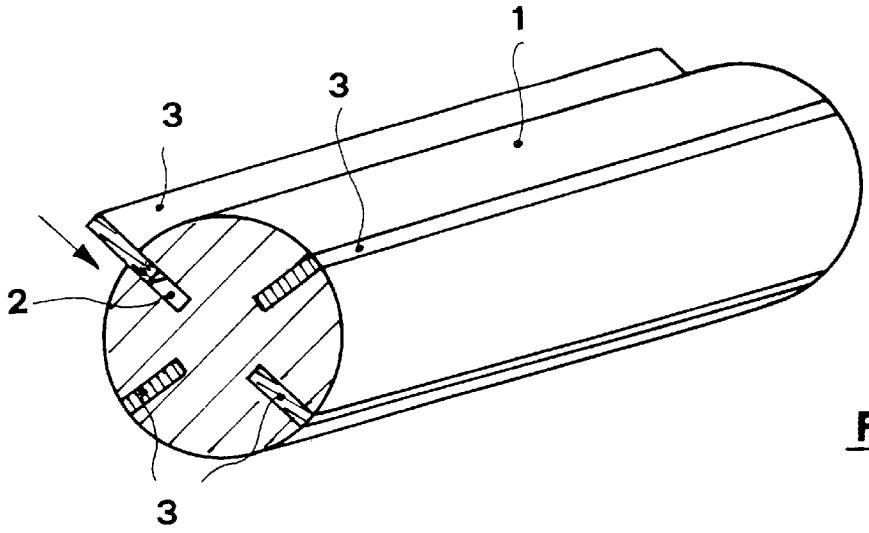
FIG. 1 is a perspective view of a length of support core with laminar sections engaged therein for the production of a composite wire according to a first embodiment of the invention.

With reference to FIG. 1, it has been indicated at 1 a length of a workpiece made of iron, copper or an alloy, having an elongate form and a circular cross section. On the side surface four grooves 2 are formed, each of which engages a flat laminar section 3 having a thickness and width equal, respectively, to the width and depth of the groove. The engagement of sections 3 in core 1 is stabilized and made permanent by means of drawing which, at the same time, reduces the dimensions of the assembly to those desired, transforming it into a wire which can be used as if it were a conventional solid wire to produce links, link chains, annular pieces of jewelry and the like. Afterwards, the opposite ends of each annular element are soldered to each other in a known way and the support core is finally removed by means of a conventional chemical or electrochemical treatment (emptying process).

Figure 2:
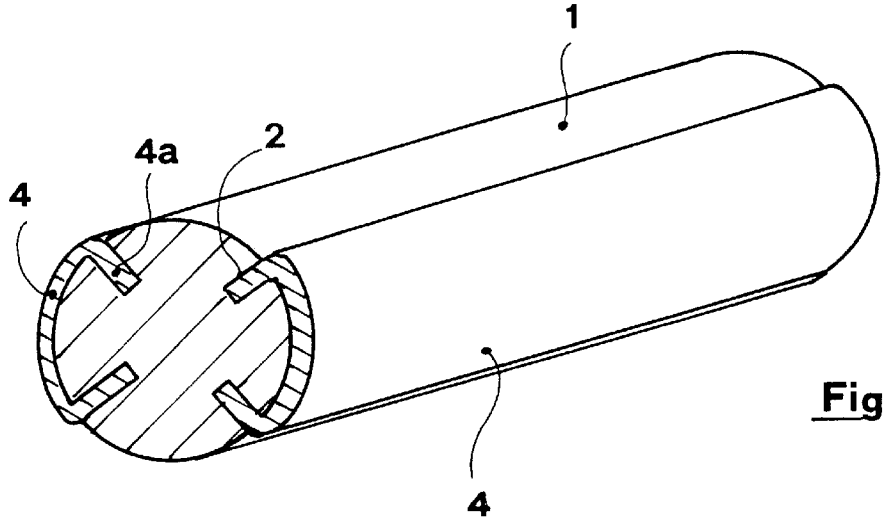
FIG. 2 is a perspective view of a length of support core with angular sections engaged therein for the production of a composite wire according to a second embodiment of the invention.

In the embodiment of the invention shown in FIG. 2, laminar sections 4 of precious metal extending along corresponding surface portions of core 1 are secured to support core 1. The anchoring of laminar sections 4 is carried out by bending their edges 4*a* into angles that engage in adjacent pairs of grooves 2 formed axially on the side surface of core 1. The engagement of edges 4*a* in support core 1 is stabilized and made permanent by drawing, as in the previous case.

Figure 3:
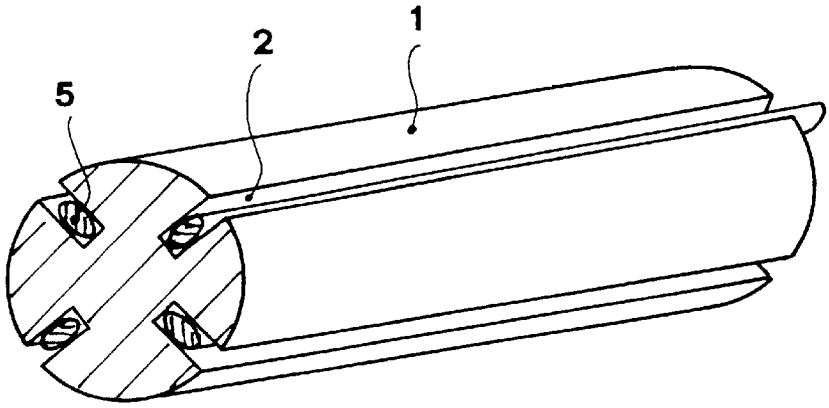
FIG. 3 is a perspective view of a length of support core with rounded sections engaged therein for the production of a composite wire according to a third embodiment of the invention.

In the embodiment of the invention shown in FIG. 3, the sections in precious metal engaged in grooves 2 of support core 1 are bars 5 with a curved cross section, in particular circular or elliptical, and a height lower than the depth of grooves 2. In this case, subjecting the assembly formed by support core 1 and bars 5 engaged in grooves 2 to drawing, the bars remain incorporated in core 1 as the pressure acting on the core closes grooves 2 over bars 5.

Figure 8:
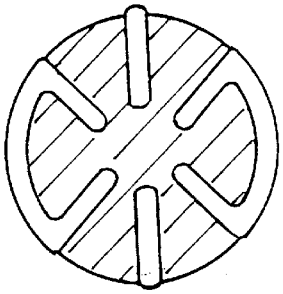
FIGS. 8, 9 and 10 show three examples of cross sections of composite wires according to the present invention which can be made by combination of different sections engaged with a support core.
Figure 9:
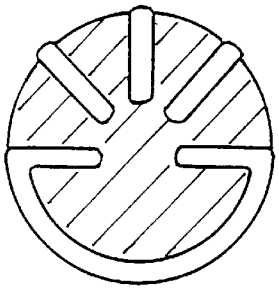
Figure 10:
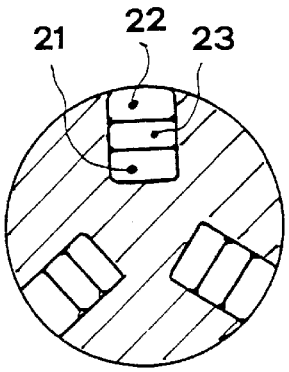

Obviously the cross section of the support core can be different from the circular one illustrated above, just as the shape, the cross section and the number of sections in precious metal engaged or incorporated in said core can be different. Furthermore, combinations of sections of different shapes and natures can be used. Non-limitative examples of such possible variations are illustrated in FIGS. 8, 9 and 10. In particular, the composite wire shown in FIG. 10 has more than one bar in precious metal inserted in each groove, for example white gold 21 and yellow gold 22 with the interposition of a bar in removable metal 23 such as copper so that, in the final product, the remaining elements in precious metal are spaced apart.

Figure 4:
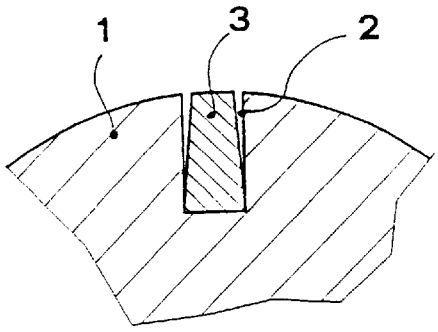
FIG. 4 is an enlarged partial cross sectional view of a possible variation of a composite wire according to the invention.

To increase the stability of the connection between the laminar sections in precious metal and the support core, the cross section of said sections can advantageously have a trapezoidal shape, substantially as illustrated in FIG. 4, with the larger base of the cross section placed at the bottom of the respective groove. In this way, as a result of the drawing, the side faces of the groove close against the corresponding side faces of the section thus creating a sort of dovetail connection which makes radial sliding impossible. Another possible solution for obtaining the same result consists in carrying out the grooves at an inclination with respect to the radial direction. Also in this case, the deformation induced by the forces of compression acting during drawing on the shape of the groove and the cross section of the section eliminate the risk of radial sliding of the section.

Figure 5:
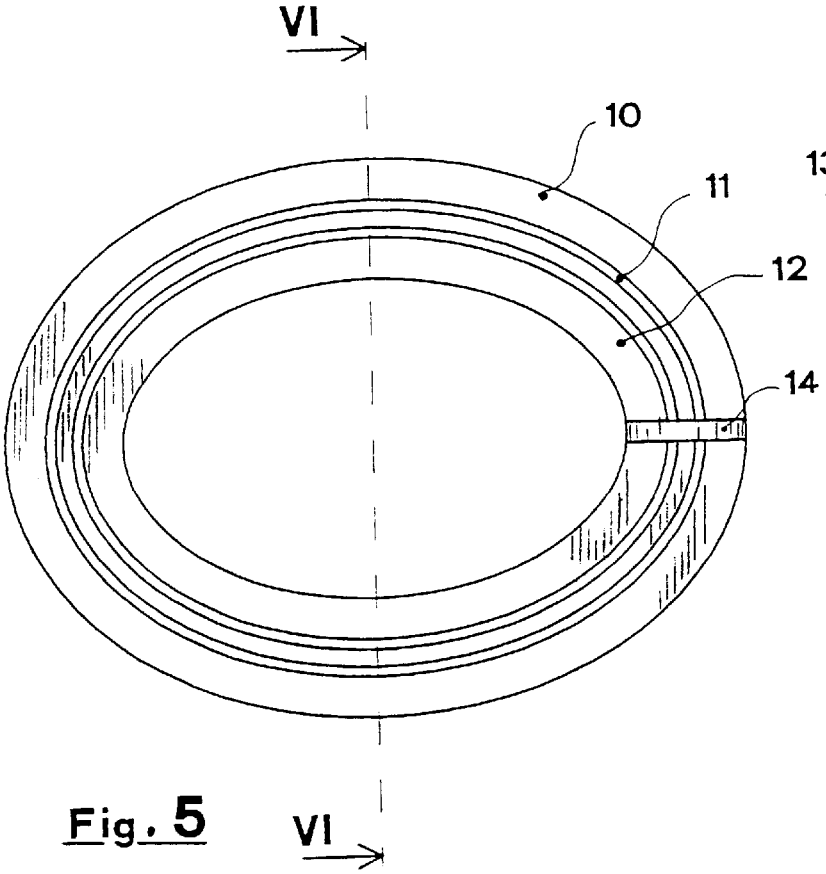
FIGS. 5 and 6 in a schematic view of an oval untwisted link, respectively in a plan view and a sectional view, made from the composite wire corresponding to FIG. 1 after it has been subjected to drawing.
Figure 6:
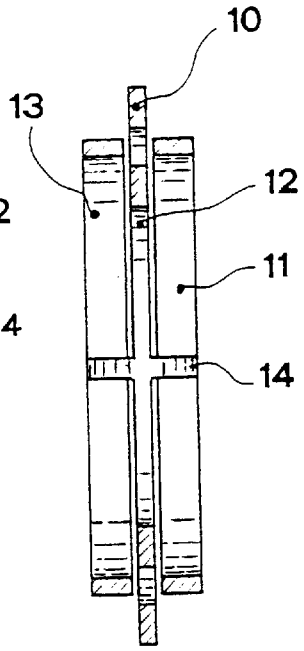

One practical example of the use of a composite wire according to the embodiment of FIG. 1 is illustrated in FIGS. 5 and 6 in which a flat oval link for ornamental chains obtained from the composite wire, following soldering and subsequent chemical emptying, is schematically shown. The link is composed of four annular flat laminar elements 10, 11, 12 and 13 extending radially from a common symmetrical circumferential axis in angularly spaced positions of 90°. The four laminar elements are fixed with their ends to the opposite faces of a transverse disc member 14 formed during soldering between the opposite ends of each link.

Obviously, in the majority of cases, the link is subjected to torsion both when it is made and when it is connected to other links and therefore the radial laminar elements will assume a twisted appearance both with respect to the circumferential axis of symmetry as well as with respect to the median plane of the link. The analogous configurations of links that can be obtained with composite wires according to the embodiments of FIGS. 2 and 3 are not illustrated since they are obvious to a person skilled in the field.

Figure 7:
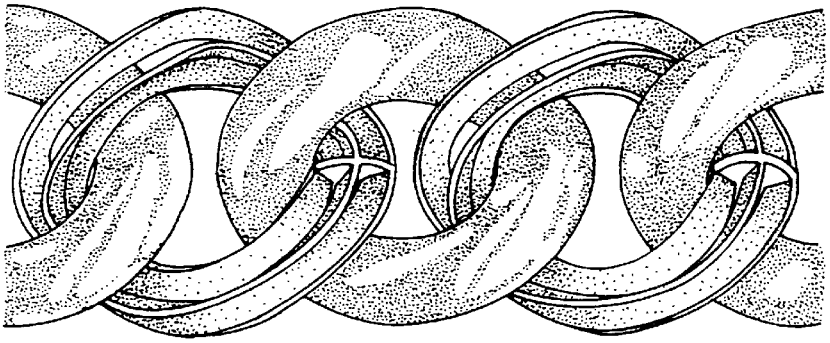
FIG. 7 shows an example of a length of ornamental chain including twisted links of the type shown in FIGS. 5 and 6.

In FIG. 7 a length of chain realized with links such as the one illustrated in FIG. 5, but subjected to torsion, combined with conventional links having a continuous surface is shown as an example.

There are many advantages to the use of the composite wire according to the invention in the field of craftsmanship of articles in precious metal. The most significant of these are the following:

- the possibility of creating links for chains, or in any case annular pieces of jewelry, in two or more different types of precious metal or in different chromatic gradations of a single precious metal, such as yellow gold, white gold and pink gold;
- the possibility of obtaining a wide variety of links for chains, or in any case annular pieces of jewelry, by varying the number, form, arrangement and combination of sections in precious metal engaged both with a mainly radial development and a circumferential development;
- the possibility of inserting more than one disc member 14 to create more discontinuities along the annular development of the piece of jewelry;
- the possibility of creating links, or in any case annular pieces of jewelry, having a mixed shape or, in other words, formed by half a link of continuous surface and half a link of radial or circumferential sections obtained by diametrically cutting one link having a conventional continuous surface and another link, such as the one in FIG. 5, of equal dimensions and subsequently soldering of the two halves together;
- the possibility of creating links, or in any case annular pieces of jewelry, having a spiral or multiple helical appearance by correspondingly twisting the composite wire before its processing, for example, in a chain making machine.

Although the most frequent foreseeable application for the composite wire according to the invention is in the field of the manufacture of ornamental chains, it is clear that it can be used also for the production of bracelets, earrings and pendants in general as well as central and intermediate elements of necklaces, chokers, bracelets and the like.

Variations and/or modifications can be brought to the composite wire for the field of gold craftsmanship according to the present invention without departing from the scope of the invention as set forth in the appended claims.

What is claimed is:

1. A composite wire for the manufacture of semifinished products to be subjected to a process of emptying to produce jewelry articles comprising an elongate support core made of a nonprecious metal that is removable by chemical or electrochemical means and a plurality of elongate sections of precious metal of which at least one portion of each is radially engaged in said core, wherein said elongate sections are either independent of one another or are connected by elongate laminar members which cover only a limited surface portion of the core.

2. A composite wire according to claim 1, wherein said sections are engaged in corresponding grooves having a depth equal to the width of said sections.

3. A composite wire according to claim 1, wherein said sections are incorporated in said core inside grooves which have a depth greater than the width of said sections and close over them.

4. A composite wire according to claim 1, wherein said sections have a substantially flat laminar form.

5. A composite wire according to claim 1, wherein said sections have a substantially curvilinear cross section.

6. A composite wire according to claim 4, wherein said sections include longitudinal edges folded to an angle on the same side in order to engage in two adjacent longitudinal grooves formed in said core and lie therebetween.

7. A composite wire according to claim 1, wherein said elongate sections comprise at least two different precious metals or at least two different colors of a single precious metal.

8. A composite wire according to claim 1, wherein said core is radially compressed, whereby said plurality of elongate sections of precious metal are frictionally engaged within corresponding grooves in said elongate support core to provide said radial engagement in said core.

9. A composite wire according to claim 1, which is a product produced by the following steps:

forming a plurality of radial grooves on said elongate support core of non-precious metal;

providing a plurality of said sections of precious metal having at least one portion adapted to engage in one of said grooves, wherein said sections are either independent of one another or are connected by elongate laminar members which cover only a limited surface portion of the core; and subjecting said core in which said sections are engaged to mechanical processing including radial compression and stretching to reduce the cross-section and to make secure said at least one portion of each of said sections within said core.

* * * * *